US012644212B2

(12) United States Patent
Oka

(10) Patent No.: US 12,644,212 B2
(45) Date of Patent: Jun. 2, 2026

(54) SEWING MACHINE

(71) Applicant: BROTHER KOGYO KABUSHIKI KAISHA, Nagoya (JP)

(72) Inventor: Hidenori Oka, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/947,520

(22) Filed: Nov. 14, 2024

(65) Prior Publication Data

US 2025/0171941 A1 May 29, 2025

(30) Foreign Application Priority Data

Nov. 27, 2023 (JP) ..... 2023-200094

(51) Int. Cl.
*D05B 35/12* (2006.01)
*D05B 73/12* (2006.01)
*D05B 79/00* (2006.01)

(52) U.S. Cl.
CPC ..... *D05B 35/12* (2013.01); *D05B 73/12* (2013.01); *D05B 79/00* (2013.01)

(58) Field of Classification Search
CPC ..... D05B 79/00; D05B 35/12; D05B 19/12; D05C 13/00
See application file for complete search history.

(56) References Cited

U.S. PATENT DOCUMENTS 5,042,410 A * 8/1991 Nakashima ..... D05B 19/02 112/306
5,195,451 A * 3/1993 Nakashima ..... D05B 79/00 112/102.5
9,739,000 B2 * 8/2017 Shimizu ..... D05B 51/00
2021/0087729 A1 3/2021 Oka et al.

FOREIGN PATENT DOCUMENTS

JP 2020-787 A 1/2020

* cited by examiner

*Primary Examiner* — Nathan E Durham
(74) *Attorney, Agent, or Firm* — Oliff PLC

(57) ABSTRACT

A sewing machine includes a projector configured to project a projection image onto a projection area above a bed. The projector is arranged on a portion of an arm and includes a first lens, and a light source emitting light guided to the first lens. When a direction orthogonal to the extending direction and the up-down direction and toward a presser bar from a needle bar is defined as a forward feed direction, and a direction opposite the forward feed direction is defined as a reverse feed direction, the light source is arranged in the forward feed direction or the reverse feed direction with respect to the first lens, and a length of the projection area in a short direction of the bed is longer than a length of the projection area in a longitudinal direction of the bed.

13 Claims, 9 Drawing Sheets

SEWING MACHINE

REFERENCE TO RELATED APPLICATIONS

This application claims priority from Japanese Patent Application No. 2023-200094 filed on Nov. 27, 2023. The entire content of the priority application is incorporated herein by reference.

BACKGROUND ART

The present disclosure relates to a sewing machine.

A known sewing machine includes a bed, an arm, a needle bar, a transfer mechanism, a projector, and a camera. The transfer mechanism can transfer a sewing object. A projector is arranged on a head of the arm, and has a first lens from which image light of a projection image is emitted and a lamp which is a light source that outputs light guided to the first lens, and projects the projection image toward a projection area of the bed. The camera is arranged on the head and has a second lens into which reflected light reflected from an imaging target is incident, and captures an image of the imaging target. The first lens of the projector and the second lens of the camera are arranged closer to the left side and the front side than the needle bar. The projection area has a rectangular shape that is long in the left-right direction.

SUMMARY

There is a demand for a wider variety of projection images in known sewing machines.

Embodiments of the broad principles derived herein provide a sewing machine capable of projecting a wider variety of projection images than ever before.

Embodiments provide a sewing machine that includes a needle bar, a presser bar, a pillar, a bed, an arm, and a projector. The needle bar is a bar on which a sewing needle is mountable. The presser bar is a bar on which a presser foot is mountable. The pillar extends in an up-down direction. The bed extends in an extending direction orthogonal to the up-down direction, from a lower end of the pillar. The arm extends in the extending direction parallel to the bed from an upper end of the pillar, above the bed. The projector is configured to project a projection image onto a projection area on the bed. The projector is arranged on a portion of the arm farther in the extending direction than the needle bar, and includes a first lens, and a light source emitting light guided to the first lens. When a direction orthogonal to the extending direction and the up-down direction and toward the presser bar from the needle bar is defined as a forward feed direction, and a direction opposite the forward feed direction is defined as a reverse feed direction, the light source is arranged in the forward feed direction or the reverse feed direction with respect to the first lens. A length of the projection area in a short direction of the bed is longer than a length of the projection area in a longitudinal direction of the bed. With a typical sewing machine, the short direction of the bed is the direction in which the sewing object is moved, i.e., the direction in which stitches are formed. In contrast, with the sewing machine of this aspect, the projector is arranged in such a direction that the light source is disposed in the forward feed direction or the reverse feed direction with respect to the first lens, in the extending direction beyond the needle bar, so the length of projection area in the short direction of the bed is longer than the length of the projection area in the longitudinal direction of the bed. Therefore, the sewing machine of this aspect is suitable for projecting images that show long patterns in the short direction of the bed, which is the direction in which stitches are formed, and contributes to the projection of a wider variety of projection images than ever before.

Embodiments also provide a sewing machine that includes a pillar, a bed, an arm, and a projector. The pillar extends in an up-down direction. The bed extends in an extending direction orthogonal to the up-down direction, from the pillar. The arm extends in the extending direction from the pillar, above the bed. The projector is configured to project a projection image onto a projection area on the bed. The projector is arranged on the arm. A length of the projection area in a forward feed direction is greater than a length of the projection area in the extending direction. The forward feed direction is a direction orthogonal to the extending direction and the up-down direction. The sewing machine of this aspect is suitable for projecting images that show long patterns in the forward feed direction, which is the direction in which stitches are formed, and contributes to the projection of a wider variety of projection images than ever before.

Embodiments further provide a sewing machine that includes a pillar, a bed, an arm, a projector, and a needle bar. The pillar extends in an up-down direction. The bed extends in an extending direction orthogonal to the up-down direction, from the pillar. The arm extends in the extending direction from the pillar, above the bed, the arm having a fixing surface. A projector is configured to project a projection image onto a projection area on the bed. The projector is fixed on the fixing surface. The projector has a first lens. The needle bar extends in the up-down direction. The needle bar is arranged between the first lens and the fixing surface in a forward feed direction. The forward feed direction is a direction orthogonal to the extending direction and the up-down direction. The projector of the sewing machine of this aspect contributes to avoiding the formation of shadows from the needle bar by the projected image light in the area farther in a direction opposite to the forward feed direction, and contributes to the projection of a wider variety of projection images than ever before.

DESCRIPTION

Figure 1:
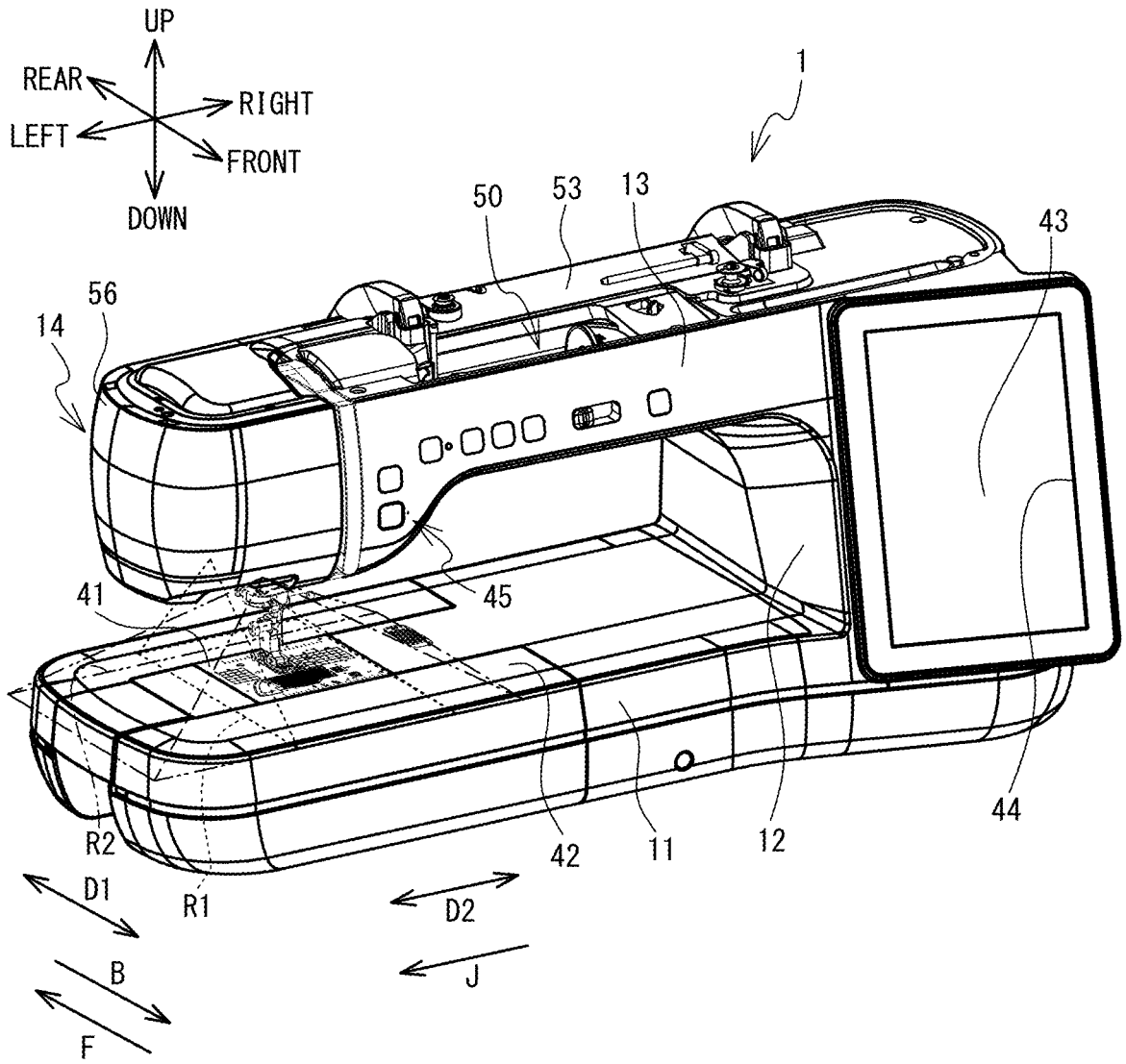
FIG. 1 is a perspective view of a sewing machine with a cover attached.

An embodiment of the present disclosure will now be described with reference to the drawings. The up-down direction, the lower left direction, the upper right direction, the upper left direction, and the lower right direction in FIG.

1 are, respectively, the up-down direction, the left direction, the right direction, the rear direction, and the front direction of a sewing machine 1. The longitudinal direction of a bed 11 and an arm 13 is the left-right direction of the sewing machine 1. The side of the sewing machine 1 on which a pillar 12 is disposed is the right side. The extension direction of the pillar 12 is the up-down direction of the sewing machine 1. The left direction is defined as extending direction J. The rear direction, which is perpendicular to the extending direction J and the up-down direction, and is a direction from a needle bar 15 toward a presser bar 16, is defined as a forward feed direction F. The front direction, which is a direction opposite the forward feed direction F, is defined as a reverse feed direction B. The forward feed direction F and the reverse feed direction B are directions along a short direction D1 of an upper surface 42 of the bed 11. The extending direction J is a direction along a longitudinal direction D2 of the upper surface 42 of the bed 11.

Figure 2:
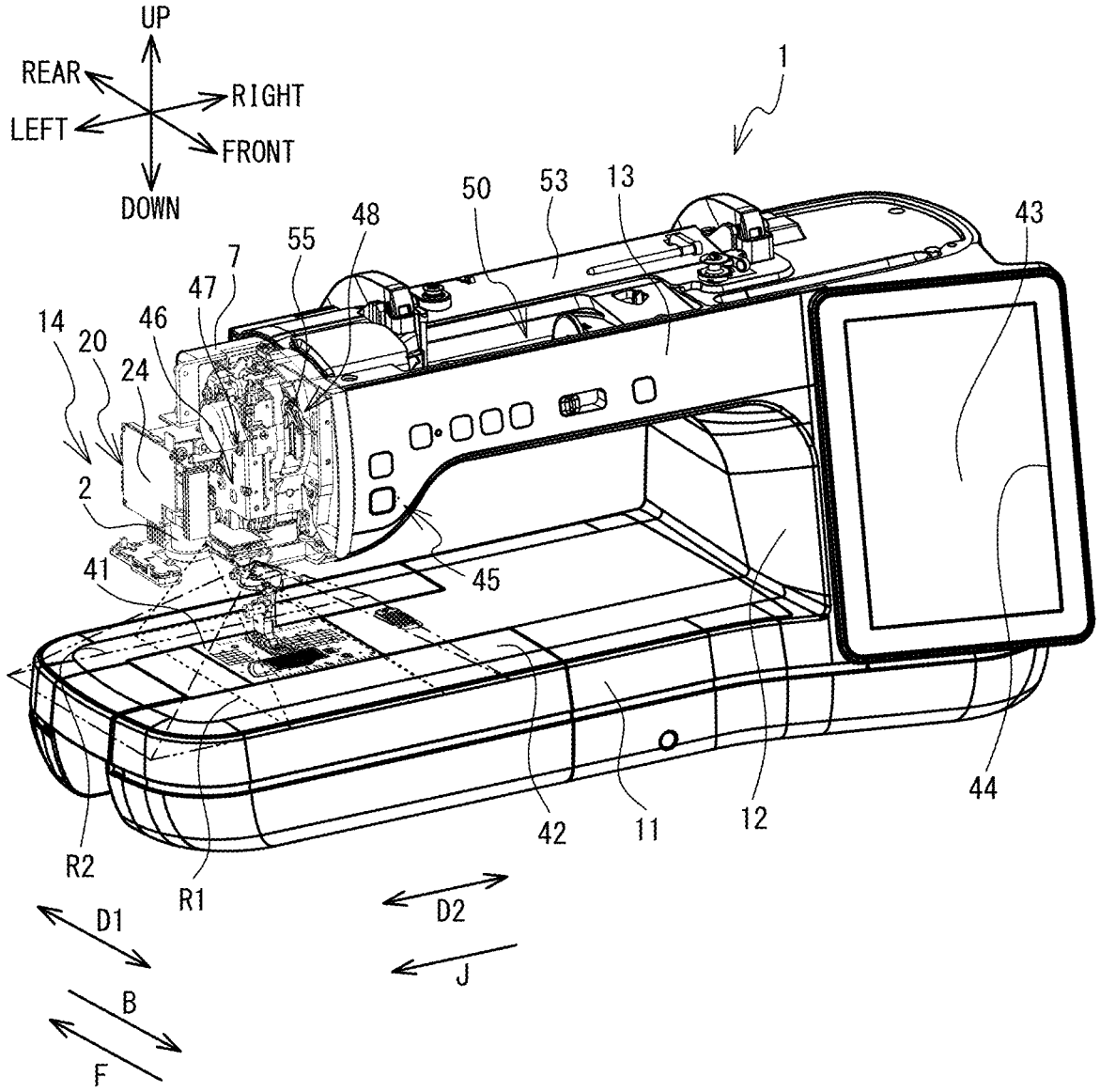
FIG. 2 is a perspective view of the sewing machine with the cover removed.

As shown in FIG. 1 and FIG. 2, the sewing machine 1 includes the bed 11, the pillar 12, and the arm 13. The pillar 12 extends in the up-down direction. The bed 11 extends in the extending direction J perpendicular to the up-down direction from a lower end of the pillar 12. The arm 13 extends in the extending direction J parallel to the bed 11 from an upper end of the pillar 12, above the bed 11. The arm 13 has a head 14 on a left end of the arm 13.

Figure 9:
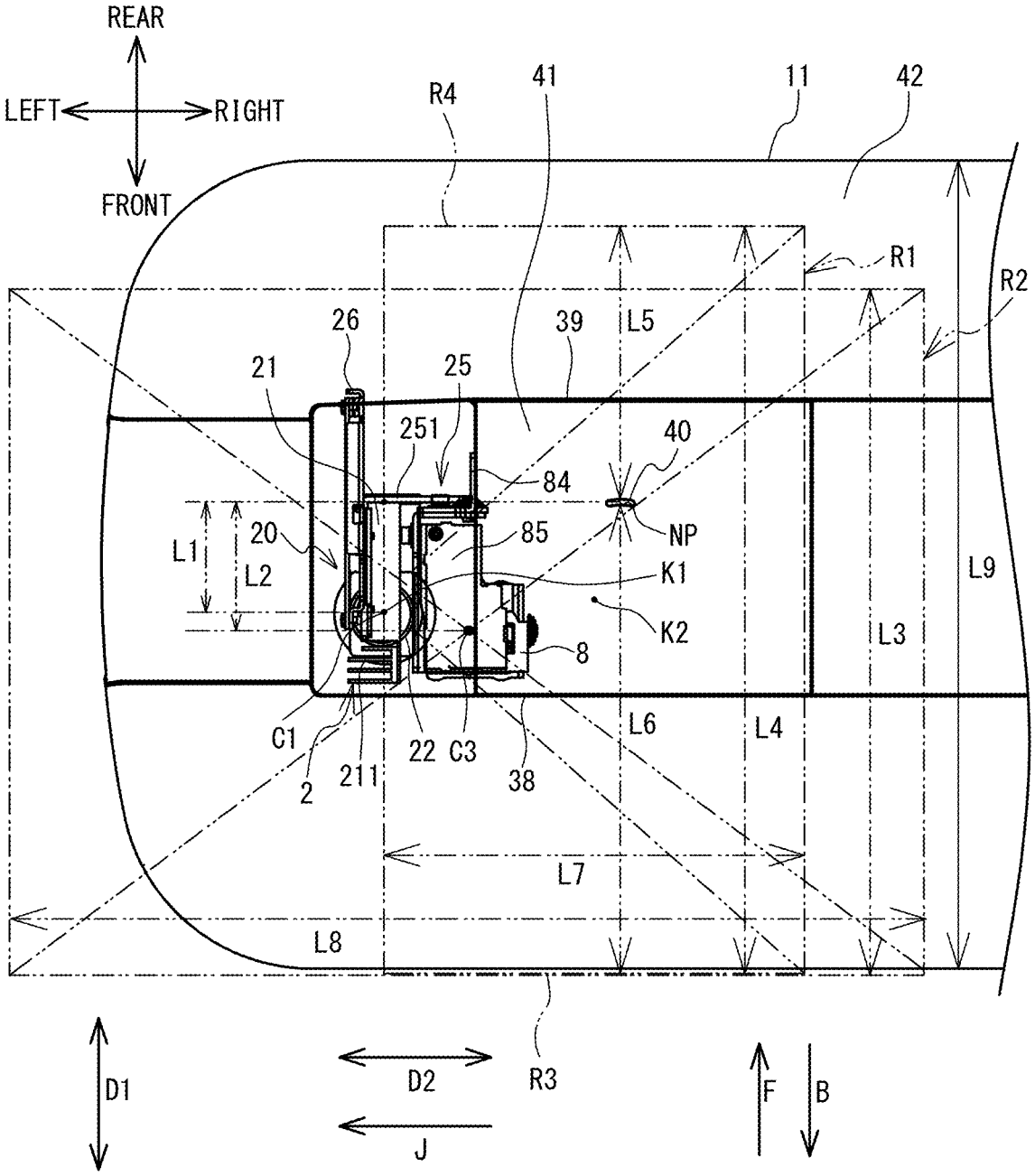
FIG. 9 is a plan view of a bed showing a projection area of the projector and an imaging area of an image sensor.

The upper surface 42 of the bed 11 extends in the horizontal direction and includes a needle plate 41. A needle hole 40 through which a sewing needle 17 passes is formed in the needle plate 41, as shown in FIG. 9. The bed 11 includes a feed mechanism and a shuttle mechanism and the like, not shown in the drawings. The feed mechanism and the shuttle mechanism are arranged below the needle plate 41. The feed mechanism includes a feed dog. The feed mechanism is configured to drive the feed dog to move the sewing object in the forward feed direction F or the reverse feed direction B by a predetermined movement amount. The forward feed direction F corresponds to the direction in which the sewing machine 1 is arranged with respect to a user. The shuttle mechanism includes a shuttle. The shuttle mechanism is configured to drive the shuttle to hook an upper thread around a lower thread.

A vertically long liquid crystal display 43 and a touch screen 44 are arranged on the front side of the pillar 12. The liquid crystal display 43 is configured to display messages and the like necessary to for sewing operations. The touch screen 44 is arranged on the front side of the liquid crystal display 43. When the user operates the touch screen 44 using a finger or a special pen, the operating position is consequently detected and an item displayed on the liquid crystal display 43 is selected. The user can input various instructions to the sewing machine 1 via the touch screen 44.

A plurality of switches including a start/stop switch 45 are arranged on the front surface of the arm 13. The start/stop switch 45 is a switch for instructing the start and stop of a sewing operation. A cover that can be opened and closed, not shown in the drawings, is arranged on a top portion of the arm 13. In FIG. 1 to FIG. 4, the cover of the arm 13 is omitted from the drawings. A thread accommodating portion 50 is arranged on an upper surface 53 of the arm 13, the upper surface 53 is exposed when the cover is open. The thread accommodating portion 50 is a recess recessed downward and is configured to accommodate a thread spool around which the upper thread is wound. A thread spool pin extends to the left from an inner wall face on the right side of the thread accommodating portion 50. The thread spool is put in the sewing machine 1 by the thread spool pin being inserted into an insertion hole in the thread spool.

The arm 13 has an arm frame 7 extending in the extending direction J from the upper end of the pillar 12, and a frame 69 connected to the front surface of the arm frame 7. A main body 70 of the arm frame 7 has a rectangular plate shape that is long in the left-right direction. The arm frame 7 is disposed in the forward feed direction F with respect to the needle bar 15 and near a rear end of the arm 13. The arm frame 7 of the present embodiment is a portion of the sewing machine frame, and corresponds to the arm 13. The sewing machine frame is formed in a U-shape that opens to the left when viewed from the front, and is arranged on each of the bed 11, the pillar 12, and the arm 13. The arm frame 7 is made of metal such as an aluminum alloy and conducts heat. The arm frame 7 has a fixing surface 72, a heat dissipation surface 73, and heat dissipation fins 74 on an end portion 71 of the arm frame 7 in the extending direction J. The fixing surface 72, the heat dissipation surface 73, and the heat dissipation fins 74 are positioned in the forward feed direction F with respect to the needle bar 15, in the short direction D1 of the bed 11. A projector 2, described later, is fixed to the fixing surface 72. The fixing surface 72 is the end portion 71 of the arm frame 7 in the extending direction J, in other words, a front surface of a left end portion of the arm frame 7. The heat dissipation surface 73 is a surface of the end portion 71 opposite to the fixing surface 72. The heat dissipation surface 73 is a back surface of the end portion 71 of the arm frame 7 in the extending direction J. The heat dissipation fins 74 extend in the forward feed direction F from the heat dissipation surface 73. The heat dissipation fins 74 include fins 741 to 744 that extend in the horizontal direction. Rear ends of the fins 741 and 742 are inclined forward as they extend the extending direction J when viewed from above. The fins 741 to 744 are lined up in the up-down direction. The intervals between any adjacent fins, among the fins 741 to 744, are all different. The surface area of the heat dissipation fins 74 is greater than the surface area of the fixing surface 72. The arm frame 7 has a recessed portion 75 that is recessed in the forward feed direction F formed to the right of the end portion 71 in the extending direction J. The frame 69 is separated from the end portion 71 in the extending direction J and is connected to a front surface of the recessed portion 75.

Figure 3:
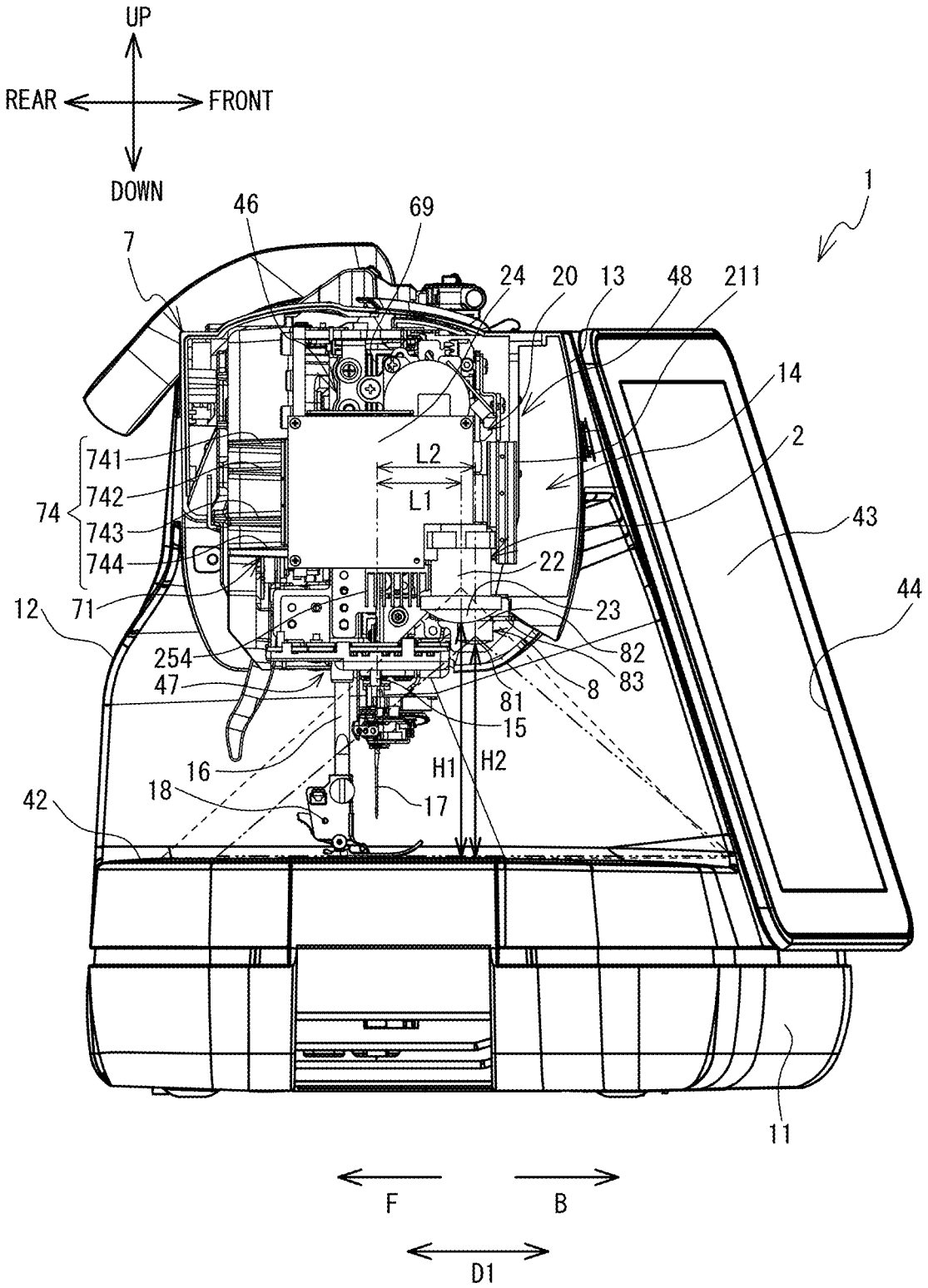
FIG. 3 is a left side view of the sewing machine with the cover removed.
Figure 4:
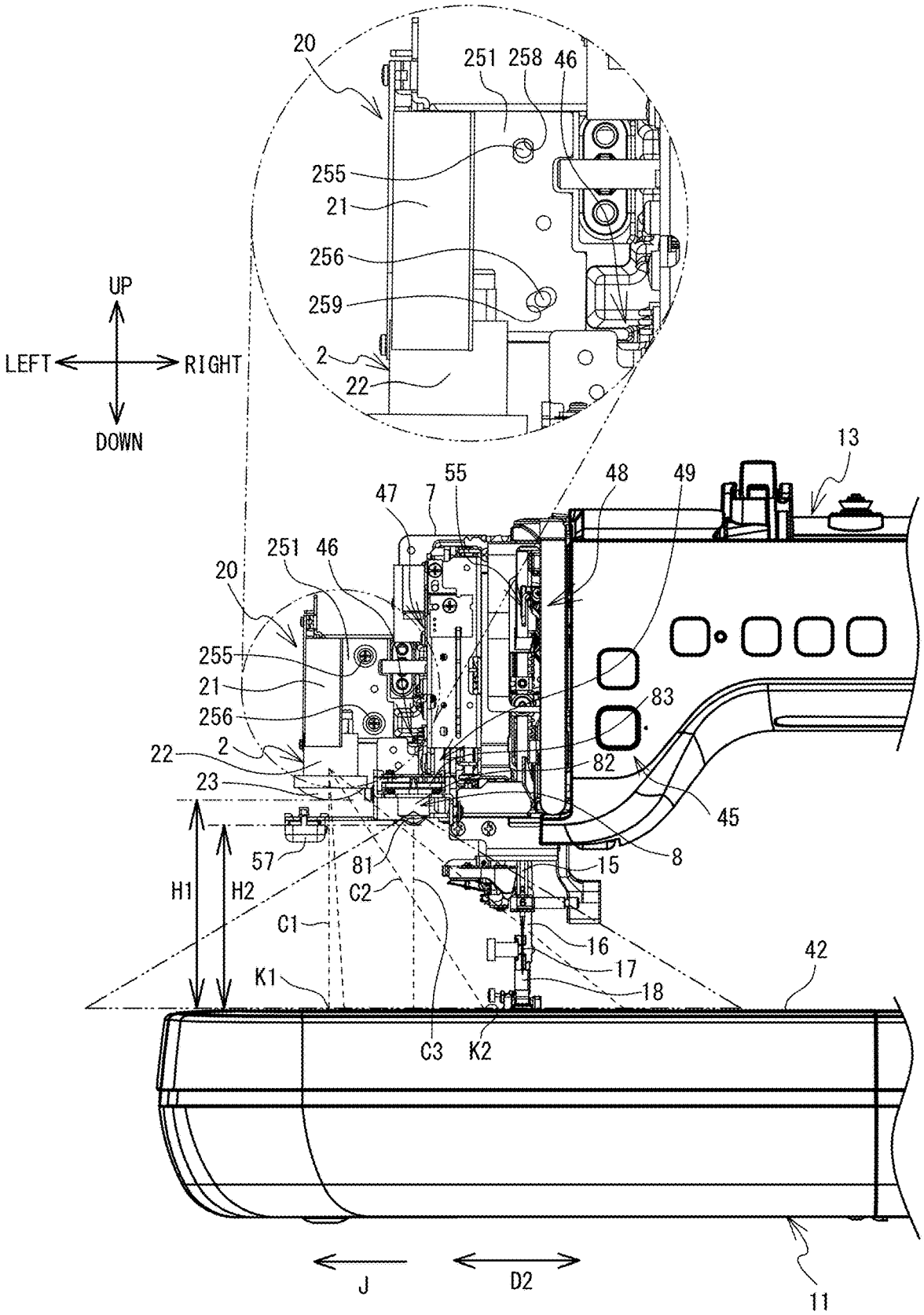
FIG. 4 is a front view of a head of the sewing machine with the cover removed.
Figure 5:
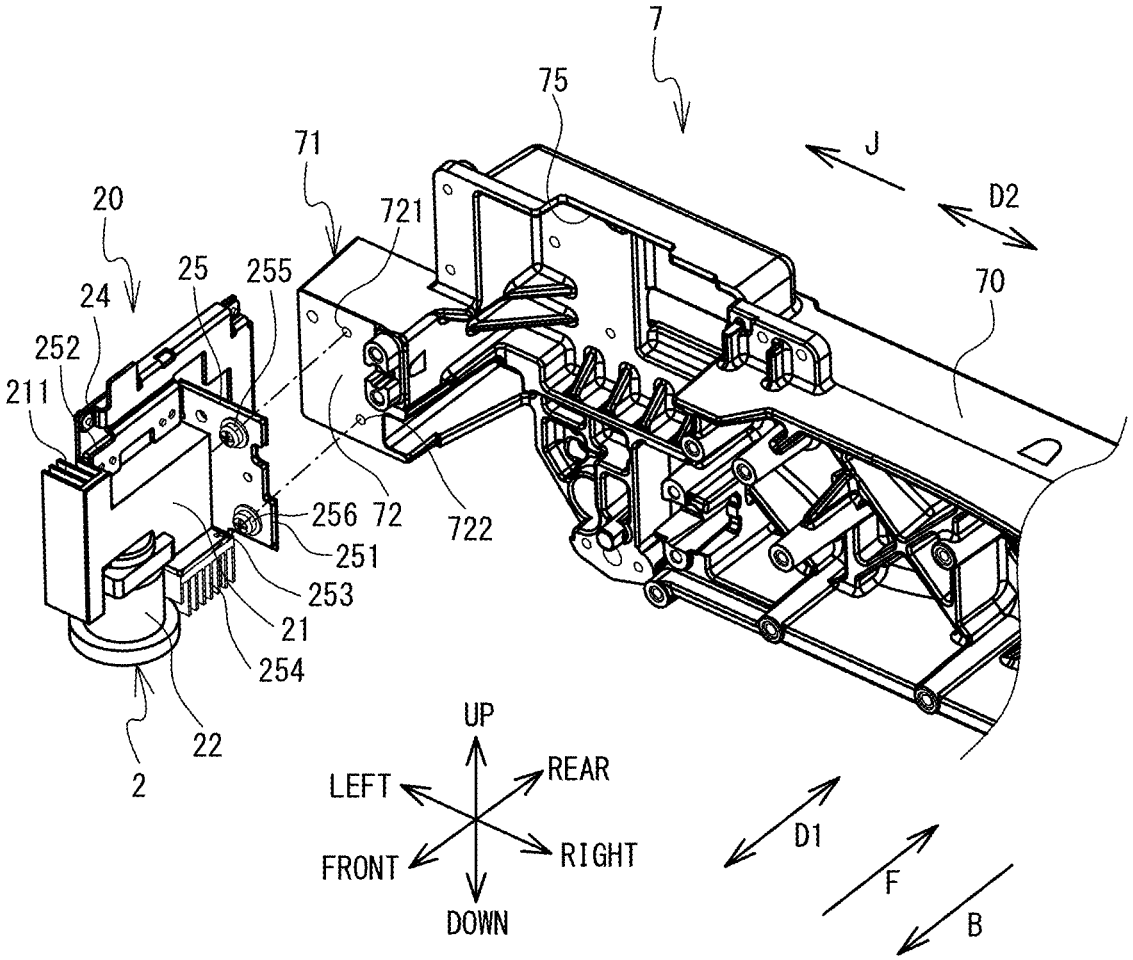
FIG. 5 is a partial perspective view of an arm frame and a projector module.
Figure 6:
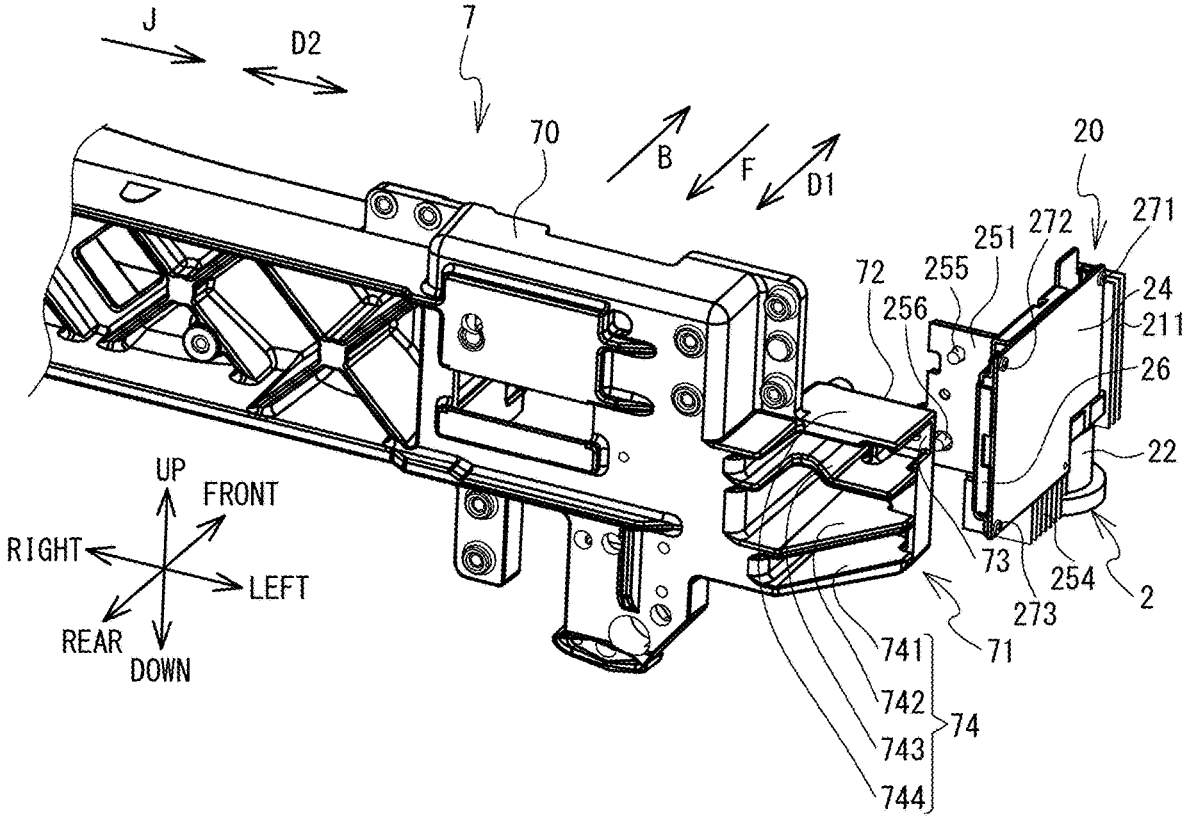
FIG. 6 is a partial perspective view of an arm frame and a projector module.
Figure 7:
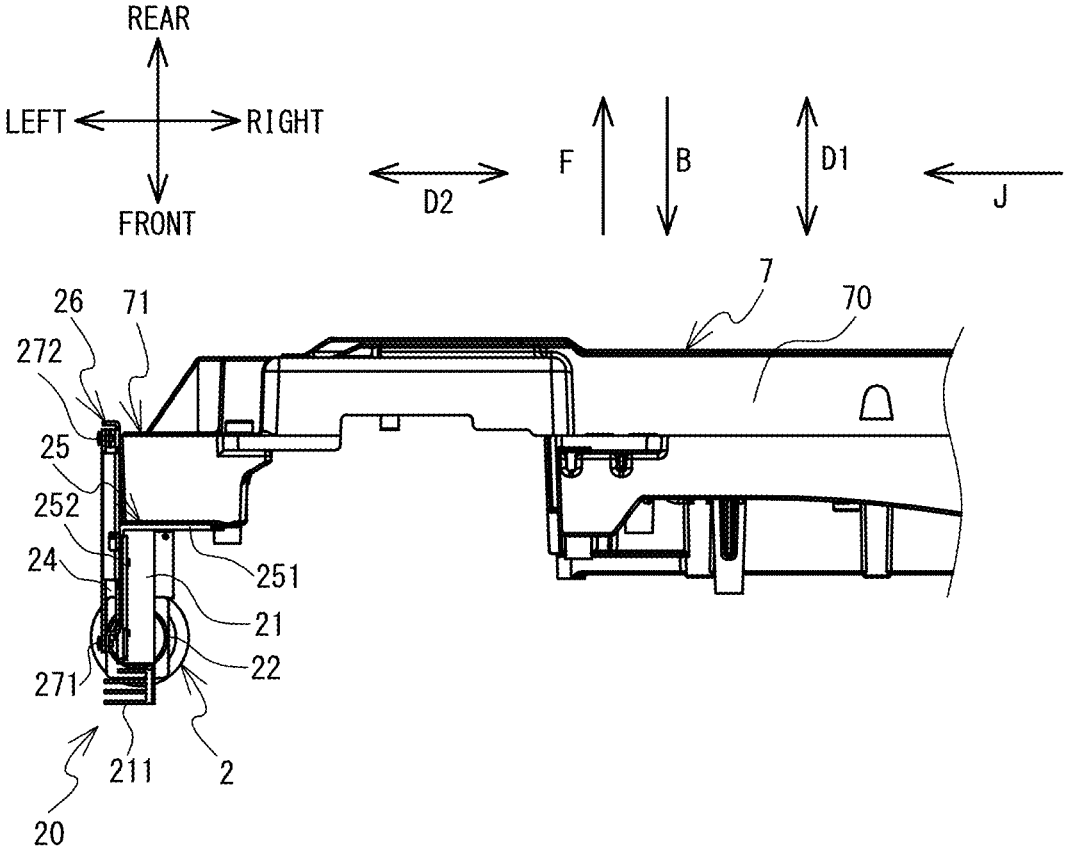
FIG. 7 is a plan view of an arm frame and a projector module.
Figure 8:
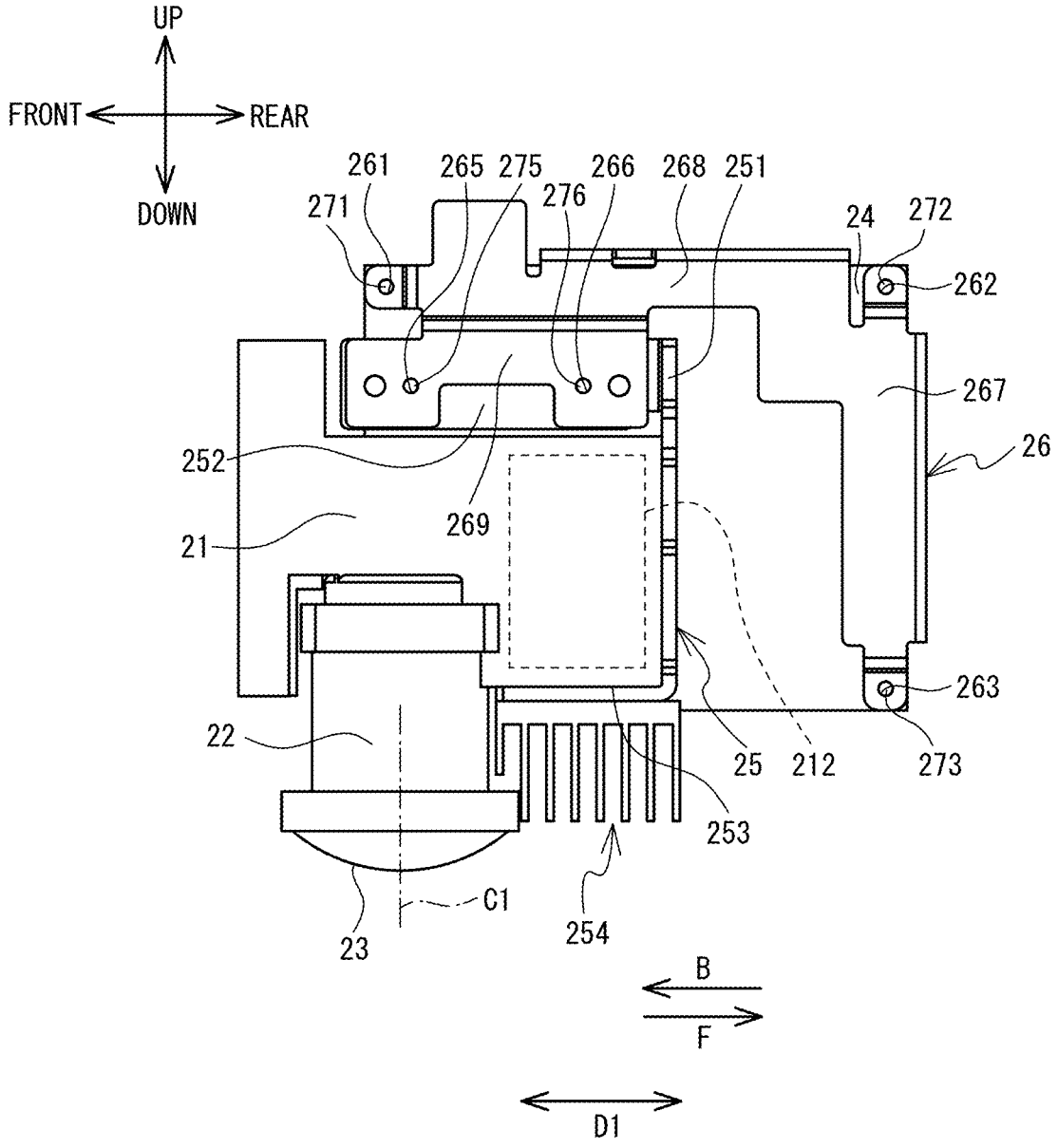
FIG. 8 is a right side view of the projector module.

As shown in FIG. 2 to FIG. 4, the head 14 includes a needle bar mechanism 46, a presser foot mechanism 47, a thread take-up lever mechanism 48, a thread-threading mechanism 49, an image sensor 8, and a projector module 20. As shown in FIG. 1, a detachable cover 56 is further arranged on the head 14. The needle bar mechanism 46, the presser foot mechanism 47, the thread take-up lever mechanism 48, the thread-threading mechanism 49, the projector module 20, and the image sensor 8 are all covered by the cover 56 when the cover 56 is attached. The needle bar mechanism 46, the presser foot mechanism 47, the thread take-up lever mechanism 48, the thread-threading mechanism 49, and the image sensor 8 are each supported by the metal frame 69. The needle bar mechanism 46, the presser foot mechanism 47, the thread take-up lever mechanism 48, and the thread-threading mechanism 49 are each supported by the arm frame 7 via the frame 69.

As shown in FIG. 2 to FIG. 4, the needle bar mechanism 46 has the needle bar 15 extending in the up-down direction, and is configured to move the needle bar 15 back and forth in the up-down direction. The needle bar 15 protrudes downward from the lower end of the head 14. The sewing needle 17 is configured to be detachably attached to the lower end of the needle bar 15. The sewing needle 17 attached to the needle bar 15 is configured to move back and forth in the up-down direction together with the needle bar 15. The upper thread inserted through the sewing needle 17 is hooked around the lower thread by the shuttle to form stitches on the sewing object.

The presser foot mechanism 47 has the presser bar 16 extending in the up-down direction, and is configured to move the presser bar 16 back and forth in the up-down direction. The presser bar 16 protrudes downward from the lower end of the head 14. A presser foot 18 is configured to be detachably attached to the lower end portion of the presser bar 16. The presser foot 18 is configured to press the sewing object downward and move the sewing object in the front-rear direction in cooperation with the feed dog.

The thread take-up lever mechanism 48 has a thread take-up lever 55 with a hole through which the upper thread passes. The thread take-up lever 55 is arranged in the reverse feed direction B, i.e., forward, with respect to the needle bar 15. The thread take-up lever mechanism 48 is configured to move the thread take-up lever 55 back and forth in the up-down direction. Therefore, the thread take-up lever 55 is configured to pull the upper thread up and adjust the position of the knot with the lower thread.

The thread-threading mechanism 49 includes a gripper 57. The gripper 57 is supported so as to be able to move in the up-down direction and rotate around an axis extending in the up-down direction. The thread-threading mechanism 49 threads the upper thread through an eyehole in the sewing needle 17 in response to the operation of the gripper 57 rotating downward.

The image sensor 8 is arranged on a front surface of the frame 69. The image sensor 8 is supported by the frame 69 via a holder 84. The image sensor 8 captures an image of an imaging area R2 on the bed 11. One example of an imaging target of the image sensor 8 is a projection image projected onto a sewing object. The image sensor 8 includes a second lens 81, a lens holder 82, and a detection portion 83. Reflected light reflected onto the object to be imaged is incident to the second lens 81. The second lens 81 guides the incident reflected light to the detection portion 83 that will be described later. The second lens 81 is arranged farther in the extending direction J than, i.e., to the left of, the needle bar 15, in the longitudinal direction D2 of the upper surface 42 of the bed 11.

The lens holder 82 is arranged on an upper end of the second lens 81 and holds the second lens 81. The detection portion 83 is arranged above the lens holder 82. The detection portion 83 is a CMOS image sensor, and is configured to detect the reflected light guided by the second lens 81 and output a signal corresponding to the detected reflected light. The detection portion 83 is not limited to the CMOS image sensor, and may instead be an image sensor that operates by another method, such as a CCD image sensor.

As shown in FIG. 9, the imaging area R2 includes at least a portion of a projection area R1 of the projector 2 which will be described later. The imaging area R2 has a rectangular shape with the sides extending in the short direction D1 of the bed 11 being the short sides and the sides extending in the longitudinal direction D2 of the bed 11 being the long sides. The length L3 of the short sides of the imaging area R2 in the present embodiment is 212 mm, and the length L8 of the long sides is 302 mm. The end of the imaging area R2 in the extending direction J is farther in the extending direction J than the end of the bed 11 in the extending direction J. The end of the imaging area R2 in the forward feed direction F is farther in the reverse feed direction B than the end of the bed 11 in the forward feed direction F. The imaging area R2 includes the extension range of the needle plate 41.

The holder 84 is interposed between the front surface of the frame 69 and the image sensor 8. The holder 84 movably supports the image sensor 8 with respect to the frame 69. The holder 84 has a relay board 85. The relay board 85 is configured to convert a signal output from the detection portion 83 of the image sensor 8 to a signal that can be detected by a control unit of the sewing machine 1, not shown in the drawings, and outputs the converted signal to the control unit. The relay board 85 has a plate shape that extends in the horizontal direction orthogonal to the up-down direction. The detection portion 83 of the image sensor 8 is held on a lower surface of the relay board 85.

As shown in FIG. 2 and FIG. 4, the projector module 20 is arranged separated from the needle bar 15 in the extending direction J. As shown in FIG. 5 to FIG. 8, the projector module 20 includes the projector 2, a control board 24, a heat dissipation plate 25, and a fixing plate 26. The projector 2 is arranged at the tip end of the arm 13, i.e., the tip end of the head 14, in the extending direction J, and is configured to project a projection image in the projection area R1 on the bed 11. The projector 2 is fixed to the fixing surface 72 of the arm frame 7. The projector 2 is capable of transferring heat generated by the projector 2 to the arm frame 7.

The projector 2 includes a generating unit 21, a light-guiding portion 22, and a first lens 23. The generating unit 21 has a cuboidal shape that is long in the front-rear direction. The generating unit 21 has a reflective display device, a light source 212, a mirror, and a prism, and the like. The light source 212 is arranged in the forward feed direction F or the reverse feed direction B with respect to the first lens 23. The light source 212 of the present embodiment is arranged in the forward feed direction F with respect to the first lens 23. The light source 212 is an RGB LED lamp, for example. The generating unit 21 generates image light of a projection image by projecting light from the light source 212 onto the image displayed on the reflective display device. The generating unit 21 emits the generated image light toward the light-guiding portion 22. The generating unit 21 may also operate by a method other than the reflective display method, such as a transmissive display device, a laser light source, or a self-luminous device. The generating unit 21 includes heat dissipation fins 211 on an end in the reverse feed direction B. The heat dissipation fins 211 are formed by a plurality of plates extending in the extending direction J, farther in the reverse feed direction B than an outer diameter centerline C1 of the first lens 23, which will be described later.

The light-guiding portion 22 has a cylindrical shape that extends in the up-down direction. The light-guiding portion 22 guides the image light generated by the generating unit 21 to the first lens 23. The image light guided by the light-guiding portion 22 is emitted toward the bed 11 via the first lens 23.

The first lens 23 is arranged on a lower end of the light-guiding portion 22. The first lens 23 is an eccentric optical projection lens. An eccentric optical system is an optical system in which a lenses and mirrors and the like that make up the optical system are not aligned in the same line. The number, type, and arrangement of the lenses and mirrors that make up the eccentric optical system may be set as appropriate. The first lens 23 of the present embodiment is a lens arranged at the bottom, from among the lenses and mirrors that make up the eccentric optical system. As shown in FIG. 2 and FIG. 4, the first lens 23 is arranged farther in the extending direction J than the second lens 81 of the image sensor 8, with respect to the needle bar 15. In the forward feed direction F, the needle bar 15 is positioned between the first lens 23, and the fixing surface 72 of the arm frame 7. In the short direction D1 of the upper surface 42 of the bed 11, the extension range of the needle bar mechanism 46 overlaps with at least a portion of the extension range of the projector 2. In the longitudinal direction D2 of the upper surface 42 of the bed 11, the extension range of the needle bar mechanism 46 is separated from the extension range of the projector 2.

As shown in FIG. 3 and FIG. 4, a projector height H1, which is the distance in the up-down direction from the first lens 23 of the projector 2 to the upper surface 42 of the bed 11, is a distance in a range of 0.8 to 1.2 times a camera height H2, which is the distance in the up-down direction from the second lens 81 of the image sensor 8 to the upper surface 42 of the bed 11. The camera height H2 of the present embodiment is less than the projector height H1. The camera height H2 is 88 mm, and the projector height H1 is 100 mm.

The longitudinal direction of the light-guiding portion 22 is substantially parallel to the outer diameter centerline C1 of the first lens 23. An intersecting point K1 of the outer diameter centerline C1 of the first lens 23 and the upper surface 42 of the bed 11 is positioned farther in the extending direction J than the center K2 of the projection area R1. A line segment connecting the center of the first lens 23 and a center K2 of the projection area R1 is defined as a projection image centerline C2. The projection image centerline C2 of the present embodiment is determined according to the position of the center of an exit surface with respect to the center of an incident surface of the first lens 23. The first lens 23 is an eccentric optical projection lens, so the outer diameter centerline C1 and the projection image centerline C2 do not coincide with each other. The inclination of the outer diameter centerline C1 of the first lens 23 with respect to the up-down direction is at least zero degree and at most 10 degrees. The projector 2 is arranged with a posture in which the first lens 23 faces approximately downward, i.e., the outer diameter centerline C1 of the first lens 23 extends approximately parallel to the up-down direction, and the projection image centerline C2 of the first lens 23 is inclined in the direction opposite the extending direction J, i.e., to the right, with respect to the up-down direction.

As shown in FIG. 9, in the longitudinal direction D2 of the bed 11, the projection area R1 of the projector 2 is positioned farther to the right, which is in direction opposite to the extending direction J, than the end of the projector 2 in the extending direction J, i.e., the left end. The projection area R1 of the projector 2 has a rectangular shape with the side extending in the short direction D1 of the bed 11 being the long side and the side extending in the longitudinal direction D2 of the bed 11 being the short side. A length L4 of the long side of the projection area R1 of the present embodiment is 239 mm, and a length L7 of the short side is 135 mm. In the short direction D1 of the bed 11, the first lens 23 is arranged in the reverse feed direction B with respect to the needle bar 15. The projection area R1 includes a needle drop position NP, which is located below the needle bar 15 on the bed 11. An end R4 of the projection area R1 in the forward feed direction F is positioned farther in the forward feed direction F than an end 39 of the needle plate 41 in the forward feed direction F. An end R3 of the projection area R1 in the reverse feed direction B is positioned farther in the reverse feed direction B than an end 38 of the needle plate 41 in the reverse feed direction B. That is, in the short direction D1 of the bed 11, the needle plate 41 is arranged between the ends R3 and R4 of the projection area R1. In the short direction D1 of the bed 11, the position of the intersecting point K1 is substantially the same as that of the center K2 of the projection area R1. A projection area length L4, which is the length of the projection area R1 in the short direction D1, is a length in a range of 0.8 to 1.2 times an imaging area length L3, which is the length of the imaging area R2 in the short direction D1. The projection area length L4, which is the length of the projection area R1 in the short direction D1, is equal to or greater than 0.9 times a bed length L9, which is the length of the upper surface 42 of the bed 11 in the short direction D1. The projection area length L4 of the present embodiment is 239 mm, the imaging area length L3 is 212 mm, and the bed length L9 is 237 mm. The projector 2 is arranged to the left in front of the needle bar 15, so when the projector 2 is driven, a shadow of the needle bar 15 is formed to the right behind the needle bar 15 by the image light projected from the projector 2. That is, a shadow formed by the image light projected from the projector 2 will not be formed in the reverse feed direction B from the needle bar 15.

In the short direction D1 of the bed 11, a projector distance L1, which is the distance in the reverse feed direction B from the needle bar 15 to the center of the first lens 23 of the projector 2, is a distance in a range of 0.8 to 1.2 times a camera distance L2, which is the distance in the reverse feed direction B from the needle bar 15 to the center of the second lens 81 of the image sensor 8. More preferably, the projector distance L1 is in a range of 0.9 to 1.1 times the camera distance L2. That is, in the short direction D1 of the bed 11, the first lens 23 of the projector 2 and the second lens 81 of the image sensor 8 are in substantially the same position. The projector distance L1 of the present embodiment is 34 mm, and the camera distance L2 is 40 mm. In the present embodiment, the center of the first lens 23 of the projector 2 is defined by the outer diameter centerline C1 of the first lens 23. In the short direction D1 of the bed 11, a reverse feed distance L6 from the needle drop position NP to the end R3 of the projection area R1 in the reverse feed direction B is 1.5 to 2.0 times a forward feed distance L5, which is the length from the needle drop position NP to the end R4 of the projection area R1 in the forward feed direction F. That is, the forward feed distance L5 is ⅓ to ⅔ the projection area length L4. More preferably, the reverse feed distance L6 is 1.6 to 1.9 times the forward feed distance L5. The forward feed distance L5 of the present embodiment is 85 mm, and the reverse feed distance L6 is 154 mm.

As shown in FIG. 5 to FIG. 8, the control board 24 is arranged in the extending direction J with respect to the generating unit 21 of the projector 2. The control board 24 has a rectangular shape when viewed from the left side. The longitudinal direction of the control board 24 is parallel to the front-rear direction. Driver elements are mounted to the control board 24. The driver elements are configured to control the projector 2 to cause the generating unit 21 to generate image light. The rear end of the control board 24 is positioned farther in the forward feed direction F than the fixing surface 72 of the end portion 71 of the arm frame 7. The front end of the control board 24 is positioned farther in the forward feed direction F than the heat dissipation fins 211.

The heat dissipation plate 25 is formed of a heat-conductive material such as metal. The heat dissipation plate 25 is fixed to the generating unit 21 and is capable of transferring heat generated by the generating unit 21 to the arm frame 7. The heat dissipation plate 25 has plate portions 251 to 253, and heat dissipation fins 254. The plate portion 251 has a rectangular plate shape when viewed from the front. The front surface of the plate portion 251 abuts against the back surface of the generating unit 21. The back surface of the plate portion 251 abuts against the fixing surface 72 of the end portion 71 of the arm frame 7. Holes 258 and 259 that pass through in the front-rear direction are formed in the plate portion 251. The hole 258 is formed above the center of the plate portion 251 in the up-down direction. The hole 258 has an oblong shape that is long in the up-down direction. The hole 259 is formed in a lower part of the plate portion 251. The hole 259 is an arc-shaped long hole centered on the hole 258. The plate portion 251 is fixed to the fixing surface 72 of the end portion 71 of the arm frame 7 by a screw 255 inserted through a screw hole 721 formed in the fixing surface 72, and the hole 258, and a screw 256 inserted through a screw hole 722 and the hole 259. The hole 259 is a long hole, so when fixing the plate portion 251 to the fixing surface 72 of the end portion 71 of the arm frame 7, an operator can adjust the posture of the plate portion 251 with respect to the fixing surface 72, in particular, the mounting angle around the screw 255 extending in the forward feed direction F, in a state in which the screws 255 and 256 are temporarily fastened. Because the needle bar mechanism 46 and other components are not located in front of the plate portion 251, the operator can easily fix the plate portion 251 to the fixing surface 72 of the end portion 71 of the arm frame 7.

The plate portion 252 extends in the reverse feed direction B from the end of the plate portion 251 in the extending direction J. The right surface of the plate portion 252 abuts against the left surface of the generating unit 21. The plate portion 253 extends horizontally in the reverse feed direction B from the lower end of the plate portion 251. The upper surface of the plate portion 253 abuts against the lower surface of the generating unit 21. The front end of the plate portion 253 abuts against the light-guiding portion 22. The lower surface of the plate portion 253 is positioned slightly higher than the lower end of the control board 24. The heat dissipation fins 254 are fixed to the lower surface of the plate portion 253 farther in the forward feed direction F than the light-guiding portion 22. The heat dissipation fins 254 protrude downward and are composed of a plurality of plates having a rectangular shape when viewed from the front. The rear ends of the heat dissipation fins 254 are positioned in substantially the same position in the front-rear direction as the rear end of the plate portion 251.

The fixing plate 26 is a bent metal plate. The fixing plate 26 connects the heat dissipation plate 25 to the control board 24. The fixing plate 26 has portions 268 and 269 that extend in the longitudinal direction D2, and a portion 267 that extends in the up-down direction. The left surface of the portions 267 and 268 abuts against the right surface of the control board 24. The portion 268 extends in the reverse feed direction B from the upper end of the portion 267. The portion 269 extends to the right from the right end of the portion 268, and then bends downward. The portion 269 is arranged above the generating unit 21. A hole 261 is formed in the front end of the portion 268, and a hole 262 is formed in the rear end of the portion 268. A hole 263 is formed in the lower end of the portion 267. Holes 265 and 266 that are lined up in the front-rear direction are formed in the portion 269. The holes 261 to 263 and 265 and 266 each have a circler shape when viewed from the right side, and pass through in the right-left direction. The fixing plate 26 is fixed to the control board 24 by a screw 271 inserted through the hole 261, a screw 272 inserted through the hole 262, and a screw 273 inserted through the hole 263. The screws 271 to 273 are each inserted through the control board 24 from the left to the right. Pins 275 and 276 arranged on the upper end of the plate portion 252 of the heat dissipation plate 25 are inserted through the holes 265 and 266. The plate portion 252 of the heat dissipation plate 25 is disposed in the left-right direction between the control board 24, and the generating unit 21 and the portion 269 of the fixing plate 26.

When the projector 2 is driven, heat generated by the generating unit 21 is dissipated through the heat dissipation fins 254 of the thermally conductive heat dissipation plate 25 that abuts against the generating unit 21, and the heat dissipation fins 211 of the generating unit 21, and is also transferred to the thermally conductive arm frame 7 through the heat dissipation plate 25. The heat dissipation fins 74 are formed on the heat dissipation surface 73 that is the back surface of the fixing surface 72 of the end portion 71 of the arm frame 7. The surface area of the heat dissipation fins 74 is greater than the sum of the surface area of the heat dissipation fins 211 and the surface area of the heat dissipation fins 254. Therefore, the end portion 71 of the arm frame 7 suitably radiates heat transferred from the generating unit 21 via the heat dissipation plate 25. The arm frame 7 has sufficient thermal conductivity and volume for the amount of heat generated by the generating unit 21. Therefore, the arm frame 7 contributes to inhibiting excessive heating of the projector 2 due to the heat generated by the generating unit 21. The projector module 20 is separated from the needle bar mechanism 46, the presser foot mechanism 47, and the thread take-up lever mechanism 48 in the left-right direction. Therefore, the heat generated by the generating unit 21 will not be transferred directly to the needle bar mechanism 46, the presser foot mechanism 47, or the thread take-up lever mechanism 48.

The operation of the sewing machine 1 having the above-described configuration will be briefly described. When the sewing machine 1 detects depression of the start/stop switch 45, the sewing machine 1 synchronously drives the shuttle mechanism, the feed mechanism, the needle bar mechanism 46, the presser foot mechanism 47, and the thread take-up lever mechanism 48. Therefore, stitches are formed in the sewing object placed on the upper surface 42 of the bed 11 by the sewing needle 17 mounted to the needle bar 15.

Usage examples of the projector 2 of the projector module 20, and image sensor 8 will now be described. The projector 2 is used, for example, to check the position and shape of stitches to be formed on the sewing object before sewing. In this case, the projector 2 emits image light of the projection image showing a pattern selected by the user, according to instructions by the user. The image light is projected onto the sewing object placed on the bed 11. In another example, the projector 2 is used to calibrate the projector 2 prior to shipment of the sewing machine 1. In this case, the projector 2 projects a predetermined calibration pattern according to instructions by the operator. The calibration pattern is, for example, grid lines arranged in a grid pattern, or the like. An image of projected calibration pattern is captured by the image sensor 8. The control unit of the sewing machine 1 detects the amount of distortion in the projected image and stores it in a memory unit, not shown in the drawings. When the control unit detects an instruction to project the image light of the projection image showing the pattern after the sewing machine 1 has been shipped, the control unit adjusts the image light emitted from the projector 2 such that distortion of the distortion amount stored in the memory unit is corrected. Therefore, the sewing machine 1 contributes to projecting image light of a projection image with no distortion onto the sewing object. The usage examples of the projector module 20 and the image sensor 8 are not limited to those described above; the projector module 20 and the image sensor 8 can be used for various other applications.

A verification test of the heat dissipation effect of the arm frame 7 on heat generated by the generating unit 21 will now be described. With a case in which the projector module 20 is not fixed to the arm frame 7 as a comparative example, and a case in which the projector module 20 is fixed to the arm frame 7 as a working example, at room temperature, the surface temperature of the generating unit 21 when the projector 2 was driven was measured for both the comparative example and the working example. The driving time of the projector 2 was 60 minutes, which is sufficient time for the surface temperature of the generating unit 21 to stabilize. In the comparative example, the surface temperature of the generating unit 21 rose from 58.7° C. to approximately 68.4° C. due to the emission of the R, G, and B LED lamps, which are the light source 212 of the generating unit 21. In contrast, in the working example, the surface temperature of the generating unit 21 was kept between 39.8° C. and 42.0° C. In the working example, the heat generated by the generating unit 21 was released to the end portion 71 of the arm frame 7, raising the temperature of the end portion 71 of the arm frame 7 several ° C., but the temperature of the main body 70 did not rise much at all. This verification test confirmed that fixing the projector module 20 to the end portion 71 of the arm frame 7 contributes to suitable dissipation of the heat generated by the generating unit 21.

When the projection area R1 is made wider than it has been in the past, the light source of the projector 2 must emit brighter light to extend the projection area, so the amount of heat to be dissipated that is generated by the light source increases. Generally, heat dissipation in a projector is performed by placing heat pipes and heat sinks and the like on the light source which is the heat source, and using an air-cooling fan. However, in a sewing machine, there are concerns about problems such as abnormal stoppages and clogging of air-cooling fans due to adhesion of thread dust and machine oil, so using an air-cooling fan is undesirable. In contrast, with the sewing machine 1 according to the above-described embodiment, heat can be efficiently transferred to the back surface side of the arm 13 by directly fixing the projector 2 to the arm frame 7, so it was verified that the sewing machine 1 contributes to inhibiting the temperature of the projector 2 from rising excessively even if an air-cooling fan is not provided.

The sewing machine 1 of the above-described embodiment includes the needle bar 15, the presser bar 16, the bed 11, the arm 13, and the projector 2. The needle bar 15 is a bar on which the sewing needle 17 is mountable. The presser bar 16 is a bar on which the presser foot 18 is mountable. The pillar 12 extends in the up-down direction. The bed 11 extends in the extending direction J orthogonal to the up-down direction from the lower end of the pillar 12. The arm 13 extends in the extending direction J parallel to the bed 11 from the upper end of the pillar 12, above the bed 11. The projector 2 is arranged on the arm 13 farther in the extending direction J than the needle bar 15, and is configured to project the projection image in the projection area R1 on the bed 11. When the direction orthogonal to the extending direction J and the up-down direction from the needle bar 15 toward the presser bar 16 is defined as the forward feed direction F, and the direction opposite the forward feed direction F is defined as the reverse feed direction B, the projector 2 has the first lens 23, and the light source 212 that is positioned in the forward feed direction For the reverse feed direction B with respect to the first lens 23 and outputs light guided to the first lens 23. The length L4 of the projection area R1 in the short direction D1 of the bed 11 is longer than the length L7 of the projection area R1 in the longitudinal direction D2 of the bed 11. In a typical sewing machine, the short direction of the bed is the direction in which the sewing object is moved, i.e., the direction in which stitches are formed. In contrast, with the sewing machine 1, the projector 2 is arranged in an orientation such that the light source 212 is positioned in the forward feed direction F or the reverse feed direction B with respect to the first lens 23, farther in the extending direction J than the needle bar 15, so the length L4 of the projection area R1 in the short direction D1 of the bed 11 is longer than the length L7 of the projection area R1 in the longitudinal direction D2 of the bed 11. Therefore, it is possible to project a projection image showing a long pattern in the short direction D1 of the bed 11, which is the direction in which stitches are formed, thus contributing to projecting a wider variety of projection image than before.

The sewing machine 1 includes the needle plate 41 arranged on the upper surface 42 of the bed 11. The projection area R1 includes the needle drop position NP positioned below the needle bar 15 on the bed 11. In the forward feed direction F, the end R4 of the projection area R1 in the forward feed direction F is positioned farther in the forward feed direction F than the end 39 of the needle plate 41 in the forward feed direction F. The projector 2 of the sewing machine 1 contributes to projecting a projection image in the projection area R1 that includes the needle drop position NP and an area farther in the forward feed direction F than the end 39 of the needle plate 41 in the forward feed direction F. Therefore, the sewing machine 1 contributes to projecting a projection image showing a pattern that extends farther in the forward feed direction F than the needle drop position NP and the needle plate 41.

The arm 13 has the arm frame 7 that extends in the extending direction J from the upper end of the pillar 12. The arm frame 7 is thermally conductive. The arm frame 7 has the fixing surface 72 which is arranged farther in the extending direction J than the needle bar 15 and fixes the projector 2. The projector 2 is fixed to the fixing surface 72 of the arm frame 7. The projector 2 is capable of transferring heat generated by the projector 2 to the arm frame 7. Typically, when the projection area of a projector is made widener than before, the amount of heat generated due to light emitted by the projector increases. Therefore, when the projection area of a projector is made wider than before, it is necessary that the heat from the projector be more effectively dissipated than before. In contrast, the arm frame 7 of the sewing machine 1 fixes the projector 2, allowing the heat generated by the projector 2 to be transferred, so the sewing machine 1 contributes to the efficient dissipation of the heat from the projector 2, even when the amount of heat generated by the light emitted by the projector 2 is more than before.

In the forward feed direction F, the fixing surface 72 is positioned in the forward feed direction F with respect to the needle bar 15. The arm frame 7 has the heat dissipation surface 73 that is on the side opposite the fixing surface 72, and the heat dissipation fins 74 that extends in the forward feed direction F from the heat dissipation surface 73. The arm frame 7 of the sewing machine 1 contributes to the efficient dissipation of heat from the projector 2 by the heat dissipation fins 74, even when the amount of heat generated by the light emitted by the projector 2 is more than before.

The sewing machine 1 includes the image sensor 8 that captures an image of the imaging area R2 on the bed 11. The projector 2 has the first lens 23. The image sensor 8 has the second lens 81. The first lens 23 of the projector 2 is arranged farther in the extending direction J than the second lens 81 of the image sensor 8. When the distance in the up-down direction from the first lens 23 of the projector 2 to the upper surface 42 of the bed 11 is defined as the projector height H1 and the distance in the up-down direction from the second lens 81 of the image sensor 8 to the upper surface 42 of the bed 11 is defined as the camera height H2, the projector height H1 is a distance in the range of 0.8 to 1.2 times the camera height H2. When the distance in the reverse feed direction B from the needle bar 15 to the centerline C1 passing through the center of the first lens 23 of the projector 2 is defined as the projector distance L1 and the distance in the reverse feed direction B from the needle bar 15 to the center C3 of the second lens 81 of the image sensor 8 is defined as the camera distance L2, the projector distance L1 is a distance in the range of 0.8 to 1.2 times the camera distance L2. The first lens 23 of the projector 2 is arranged farther in the extending direction J than the second lens 81 of the image sensor 8, with respect to the needle bar 15. With the sewing machine 1, the second lens 81 of the image sensor 8 and the first lens 23 of the projector 2 are arranged in positions relatively close together in the up-down direction and the reverse feed direction B, and the second lens 81 of the image sensor 8 is arranged closer to the needle bar 15 than the first lens 23 of the projector 2 in the extending direction J, which contributes to increasing convenience when calibrating the projector 2 using the image captured by the image sensor 8, compared to when the second lens 81 of the image sensor 8 and the first lens 23 of the projector 2 are arranged relatively far apart from each other and the second lens 81 of the image sensor 8 is arranged far from the needle bar 15.

Generally, when sewing a pattern with the sewing machine 1, the feed dog is driven to move the sewing object in the forward feed direction For the reverse feed direction B, i.e., along the short direction D1, which often results in sewing a long pattern in the short direction D1. The projection area R1 of the sewing machine 1 of the present embodiment has a long shape in which the side of the bed 11 extending in the short direction D1 is the long side, and the side of the bed 11 extending in the longitudinal direction D2 is the short side. The sewing machine 1 can thus contribute to projecting a projection image in the projection area R1 having a rectangular shape in which the short direction D1 of the bed 11 is the long side. Therefore, the sewing machine 1 is suitable for projecting a projection image showing a long pattern in the short direction D1.

The projector 2 includes the first lens 23 that is an eccentric optical projection lens. The intersecting point K1 of the outer diameter centerline C1 of the first lens 23, which is an eccentric optical projection lens, and the bed 11 is positioned farther in the extending direction J than the center K2 of the projection area R1. The sewing machine 1 thus contributes to inhibiting the size of the end of the arm 13 in the extending direction J, i.e., the size of the head 14, from becoming larger compared to a case in which the projector 2 does not include an eccentric optical projection lens, under the condition of projecting on the same projection area R1.

The inclination of the outer diameter centerline C1 of the first lens 23 which is an eccentric optical projection lens with respect to the up-down direction is at least zero degree and at most 10 degrees. The sewing machine 1 contributes to inhibiting the size of the end of the arm 13 in the extending direction J, i.e., the size of the head 14, from becoming larger compared to a case in which the inclination of outer diameter centerline C1 of the eccentric optical projection lens with respect to the up-down direction is greater than 11 degrees.

The projection area length L4, which is the length of the projection area R1 in the short direction D1 of the bed 11, is a length in the range of 0.8 to 1.2 times the imaging area length L3, which is the length of the imaging area R2 in the short direction D1 of the bed 11. The image sensor 8 of the sewing machine 1 contributes to increasing the convenience when calibrating the projector 2 using the image captured by the image sensor 8, compared to when the projection area length L4 in the short direction D1 of the bed 11 in the projection area R1 is not the range of 0.8 to 1.2 times the projection area length L4 of the imaging area R2 in the short direction D1.

The reverse feed distance L6 from the needle drop position NP to the end of the projection area R1 in the reverse feed direction B is 1.5 to 2.0 times the forward feed distance L5, which is the length from the needle drop position NP to the end of the projection area R1 in the forward feed direction F. The projector 2 of the sewing machine 1 contributes to projecting the projection image in an area farther in the forward feed direction F than the needle drop position NP, while the making the area of the projection area R1 farther in the reverse feed direction B than the needle drop position NP larger than the area of the projection area R1 farther in the forward feed direction F than the needle drop position NP. Therefore, the projector 2 contributes to projecting the projection image showing a pattern extending farther in the forward feed direction F than the needle drop position NP.

The arm 13 has the arm frame 7 that has the fixing surface 72 which is arranged farther in the extending direction J than the needle bar 15 and fixes the projector 2. In the short direction D1 of the bed 11, the fixing surface 72 is arranged in the forward feed direction F with respect the needle bar 15. The first lens 23 is arranged in the reverse feed direction B with respect to the needle bar 15. The projector 2 of the sewing machine 1 contributes to avoiding the formation of shadows from the needle bar 15 and the presser bar 16 by the projected image light in the area farther in the reverse feed direction B than the needle drop position NP, by arranging the first lens 23 farther in the reverse feed direction B than the needle bar 15, in the short direction D1 of the bed 11. The projector 2 of the sewing machine 1 is fixed to the fixing surface 72 of the arm frame 7 in the forward feed direction F, which contributes to transferring heat generated by the projector 2 farther in the forward feed direction F than the needle bar 15.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The present disclosure is not limited to the above-described embodiments, and may be modified in a variety of ways. The sewing machine 1 may have a transport mechanism that is configured to transfer an embroidery frame in the front-rear and left-right directions. The sewing machine 1 may sew an embroidery pattern while moving a sewing object held on the embroidery frame in the front-rear and left-right directions using the transport mechanism.

The type, arrangement, and projection area R1 of the projector 2 may be modified as appropriate. The projection area R1 need not include the needle drop position NP. The projection area R1 may have a shape other than a rectangular shape, such as a trapezoidal shape or an oval shape or the like, or may have a rectangular shape with the side extending in the extending direction J as the long side. The end R4 of the projection area R1 in the forward feed direction F may be arranged farther in the reverse feed direction B than the end 39 of the needle plate 41 in the forward feed direction F. The light source 212 of the projector 2 may be arranged in the reverse feed direction B with respect to the first lens 23.

The projector 2 need not be fixed to the arm frame 7. When the projector 2 is fixed to the arm frame 7, the fixing surface 72 does not have to be the surface in the reverse feed direction B of the end portion 71 in the extending direction J. For example, the fixing surface 72 may be the surface of the end portion 71 in the extending direction J, or the lower surface of the end portion 71. The projector 2 may be fixed to the fixing surface 72 of the arm frame 7 in such a way that heat generated by the projector 2 cannot be transferred. The fixing surface 72 may be positioned in the reverse feed direction B with respect to the needle bar 15. The arm frame 7 may omit the heat dissipation surface 73 on the side opposite the fixing surface 72, or the heat dissipation fins 74 that extend in the forward feed direction F from the heat dissipation surface 73. The direction in which the heat dissipation fins 74 extend may be changed to downward or upward or the like as appropriate. The shape, size, number, and arrangement of the fins 741 to 744 of the heat dissipation fins 74 may be changed as appropriate.

The sewing machine 1 need not include the image sensor 8. The type, arrangement, and imaging area R2 of the image sensor 8 may be changed as appropriate. The projector height H1 may be less than 0.8 times, or greater than 1.2 times, the camera height H2. The projector distance L1 may be less than 0.8 times, or greater than 1.2 times, the camera distance L2. The first lens 23 of the projector 2 may be arranged farther in the opposite direction of the extending direction J than the second lens 81 of the image sensor 8, with respect to the needle bar 15. The projector 2 need not include the first lens 23 that is an eccentric optical projection lens. The inclination of the outer diameter centerline C1 of the first lens 23, which is an eccentric optical projection lens, with respect to the up-down direction may be greater than 10 degrees. The projection area length L4 may be less than 0.8 times, or greater than 1.2 times, the imaging area length L3. In the short direction D1 of the bed 11, the reverse feed distance L6 may be less than 1.5 times, or greater than 2.0 times, the forward feed distance L5. The fixing surface 72 may be arranged in the reverse feed direction B with respect to the needle bar 15. The first lens 23 may be arranged in the forward feed direction F with respect to the needle bar 15. The projector height H1 may be the distance in the up-down direction from the focal point of the projector 2 to the upper surface 42 of the bed 11, and the camera height H2 may be the distance in the up-down direction from the focal point of the image sensor 8 to the upper surface 42 of the bed 11. In this case, the projector height H1 is preferably a distance in the range of 0.8 to 1.4 times the camera height H2.

What is claimed is:

1. A sewing machine comprising:

a needle bar on which a sewing needle is mountable;

a presser bar on which a presser foot is mountable;

a pillar extending in an up-down direction;

a bed extending in an extending direction orthogonal to the up-down direction, from a lower end of the pillar;

an arm extending in the extending direction parallel to the bed from an upper end of the pillar, above the bed;

a projector configured to project a projection image onto a projection area on the bed, the projector being arranged on a portion of the arm farther in the extending direction than the needle bar, and including a first lens, and a light source emitting light guided to the first lens, and, when a direction orthogonal to the extending direction and the up-down direction and toward the presser bar from the needle bar is defined as a forward feed direction, and a direction opposite the forward feed direction is defined as a reverse feed direction, the light source being arranged in the forward feed direction or the reverse feed direction with respect to the first lens, and a length of the projection area in a short direction of the bed being longer than a length of the projection area in a longitudinal direction of the bed; and a needle plate arranged on an upper surface of the bed, wherein the projection area includes a needle drop position positioned below the needle bar on the bed, and an end of the projection area in the forward feed direction is positioned farther in the forward feed direction than an end of the needle plate in the forward feed direction.

2. The sewing machine according to claim 1, wherein the arm has an arm frame extending in the extending direction from the upper end of the pillar, the arm frame being thermally conductive and having a fixing surface arranged in the extending direction with respect to the needle bar and fixes the projector, and the projector is fixed to the fixing surface of the arm frame, the projector is capable of transferring heat generated by the projector to the arm frame.

3. The sewing machine according to claim 2, wherein the fixing surface is positioned in the forward feed direction with respect to the needle bar, and the arm frame has a heat dissipation surface on a side opposite the fixing surface, and a heat dissipation fin extending in the forward feed direction from the heat dissipation surface.

4. The sewing machine according to claim 1, further comprising:

an image sensor configured to capture an image of an imaging area on the bed, the image sensor having a second lens, wherein the first lens of the projector is arranged farther in the extending direction than the second lens of the image sensor, when a distance in the up-down direction from the first lens of the projector to an upper surface of the bed is defined as a projector height and a distance in the up-down direction from the second lens of the image sensor to the upper surface of the bed is defined as a camera height, the projector height is a height in a range of 0.8 to 1.2 times the camera height, when a distance in the reverse feed direction from the needle bar to a center of the first lens of the projector is defined as a projector distance and a distance in the reverse feed direction from the needle bar to a center of the second lens of the image sensor is defined as a camera distance, the projector distance is a distance in a range of 0.8 to 1.2 times the camera distance, and the first lens of the projector is arranged farther in the extending direction than the second lens of the image sensor, with respect to the needle bar.

5. The sewing machine according to claim 4, wherein when a length of the projection area in the short direction of the bed is defined as a projection area length and a length of the imaging area in the short direction of the bed is defined as an imaging area length, the projection area length is a length in a range of 0.8 to 1.2 times the imaging area length.

6. The sewing machine according to claim 1, wherein the projection area has a rectangular shape with a side extending in the short direction of the bed being a long side, and a side extending in the longitudinal direction of the bed being a short side.

7. The sewing machine according to claim 1, wherein the first lens is an eccentric optical projection lens, and an intersecting point of an outer diameter centerline of the eccentric optical projection lens and the bed is positioned farther in the extending direction than a center of the projection area.

8. The sewing machine according to claim 7, wherein an inclination of the outer diameter centerline of the eccentric optical projection lens with respect to the up-down direction is at least zero degree and at most 10 degrees.

9. The sewing machine according to claim 1, wherein when a distance from the needle drop position to an end in the reverse feed direction of the projection area in the short direction of the bed is defined as a reverse feed distance and a distance from the needle drop position to the end in the forward feed direction of the projection area in the short direction of the bed is defined as a forward feed distance, the reverse feed distance is a distance in a range of 1.5 to 2.0 times the forward feed distance.

10. The sewing machine according to claim 1, wherein the arm has an arm frame having a fixing surface arranged in the extending direction with respect to the needle bar and fixes the projector, the fixing surface is arranged in the forward feed direction with respect to the needle bar, and the first lens is arranged in the reverse feed direction with respect to the needle bar.

11. A sewing machine comprising:

a pillar extending in an up-down direction;

a bed extending in an extending direction orthogonal to the up-down direction, from the pillar;

an arm extending in the extending direction from the pillar, above the bed;

a projector configured to project a projection image onto a projection area on the bed, the projector being arranged on the arm, and a length of the projection area in a forward feed direction being greater than a length of the projection area in the extending direction, the forward feed direction being a direction orthogonal to the extending direction and the up-down direction; and a needle plate arranged on an upper surface of the bed, wherein both ends of the needle plate being positioned between both ends of the projection area in the forward feed direction.

12. A sewing machine comprising:

a pillar extending in an up-down direction;

a bed extending in an extending direction orthogonal to the up-down direction, from the pillar;

an arm extending in the extending direction from the pillar, above the bed, the arm having a fixing surface;

a projector configured to project a projection image onto a projection area on the bed, the projector being fixed on the fixing surface, the projector having a first lens; and a needle bar extending in the up-down direction, the needle bar being arranged between the first lens and the fixing surface in a forward feed direction, the forward feed direction being a direction orthogonal to the extending direction and the up-down direction, wherein the needle bar is arranged between the pillar and the projector in the extending direction, the first lens is an eccentric optical projection lens, and the projection area includes a needle drop position positioned below the needle bar on the bed.

13. The sewing machine according to claim 12, wherein the arm has an arm frame having the fixing surface.

* * * * *